United States Patent [19]

Smalley et al.

[11] 4,093,094

[45] June 6, 1978

[54] HOME CANNING SYSTEM

[75] Inventors: Ned J. Smalley, Perrysburg; Ralph H. Whitney, Whitehouse, both of Ohio

[73] Assignee: Owens-Illinois, Inc., Toledo, Ohio

[21] Appl. No.: 782,272

[22] Filed: Mar. 28, 1977

[51] Int. Cl.[2] ..... B65D 45/10

[52] U.S. Cl. ..... 215/276; 215/350

[58] Field of Search ..... 215/276, 350, 274

[56] References Cited

U.S. PATENT DOCUMENTS

| | | | |
|---|---|---|---|
| 1,010,285 | 11/1911 | Mackin | 215/276 |
| 1,237,640 | 8/1917 | Hammer | 215/276 |
| 1,250,058 | 12/1917 | Weaver | 215/276 |
| 1,615,533 | 1/1927 | Brown | 215/276 |
| 1,999,622 | 4/1935 | Argeo | 215/276 |
| 2,270,729 | 1/1942 | Geddes | 215/276 |
| 2,449,014 | 9/1948 | Shaffer | 215/276 |
| 2,498,930 | 2/1950 | Wadsworth | 215/276 |
| 3,491,908 | 1/1970 | Beimers | 215/276 |
| 3,586,196 | 6/1971 | Barton | 215/344 |
| 3,836,033 | 9/1974 | Podesta | 215/276 |

FOREIGN PATENT DOCUMENTS

| | | | |
|---|---|---|---|
| 4,922 of | 1903 | United Kingdom | 215/276 |

*Primary Examiner*—Ro E. Hart

*Attorney, Agent, or Firm*—Alan J. Steger; Myron E. Click; David H. Wilson

[57] ABSTRACT

An improved home canning closure system is provided for a home canning jar featuring a plastic ring and a metal lid combination which is adapted to allow excess pressure to escape while preventing the escape of the contents from the container. The plastic ring includes an annular top panel portion and a skirt portion depending downwardly from the outer periphery of the top panel portion. The skirt portion incorporates buttress threads on its inner surface to engage threads on the external neck of the home canning jar. The plastic ring features an upwardly and outwardly inclined ramp portion on its lower surface and a thin section at the junction of the top panel and skirt portions which combine to form a spring member to maintain a constant force to bias the metal lid into sealing engagement with the upper rim on the home canning jar.

1 Claim, 3 Drawing Figures

HOME CANNING SYSTEM

BACKGROUND OF THE INVENTION

This invention relates to home canning closure systems and more particularly it relates to an improved home canning closure system featuring a plastic ring and a metal lid combination which is adapted to allow excess pressure to escape while preventing the escape of the contents of the container.

Closure systems for a home canning jar have traditionally comprised a metal lid and a metal ring which fits over the metal lid and incorporates threads adapted to engage mating threads in the jar. The metal lid serves to seal or close the open mouth of the jar, and the metal ring serves to hold the metal lid in place until such time as a vacuum is created in the jar. The metal ring also provides a protective cover to prevent dislodging of the metal lid after the creation of a vacuum in the jar which holds the metal lid in place.

A sterilized home canning jar is filled with the product being canned while hot and then a sterilized metal lid is placed thereover and a metal ring is then threaded into engagement with the canning jar to hold the metal lid in sealing engagement with the jar. As the product cools, a vacuum is created in the headspace above the product in the jar which then holds the metal lid in sealing engagement with the jar. In the home canning of certain products, the jar is partially or fully immersed in boiling water after it has received the hot product and the closure system. This continued heating of the package creates increased pressure within the jar which must be allowed to escape. Thus, the metal lid and metal ring will flex slightly to allow some pressure to escape from the jar.

However, the metal rings have been found to have a rather short life span due to corrosion and rust. Even if they are re-used, they have a rather unpleasant appearance.

GENERAL DESCRIPTION OF THIS INVENTION

It is, therefore, an object of this invention to provide an improved home canning closure system which eliminates the defects and objections associated with the conventionally used metal lid and metal ring combination.

This invention provides an improved plastic ring which is utilized with a metal lid to provide an effective home canning closure system. The plastic ring does not corrode or rust and may be re-used many times without any deterioration of its appearance. In addition, a plastic ring, when presented in various colors, provides a far more attractive package than does a metal ring and facilitates denoting of the various products being canned by the use of certain color rings.

This improved plastic ring of this invention includes an annular top panel portion and a skirt portion depending downwardly from the outer periphery of the top panel portion. The skirt portion incorporates buttress threads on its inner surface to engage threads on the external neck of the home canning jar. The plastic ring features an upwardly and outwardly inclined ramp portion on its lower surface and a thin section at the junction of the top panel and skirt portions which combine to form a spring member to bias the metal lid into sealing engagement with the upper rim on the home canning jar. These features counteract the tendency of the plastic ring to expand under the influence of heat and pressure from the hot, product-filled jar. As the pressure builds up within the jar, the metal lid and plastic ring are adapted to flex slightly to release or vent some of the pressure from within the jar. But the unique combination of the ramp portion and spring member return the metal lid into sealing engagement with the upper rim on the jar to prevent loss of product from within the jar.

Other objects, features, and advantages of this invention will become obvious to one skilled in the art upon reference to the following detailed description and the drawings illustrating a preferred embodiment thereof.

IN THE DRAWINGS

DETAILED DESCRIPTION OF A PREFERRED EMBODIMENT

Figure 1:
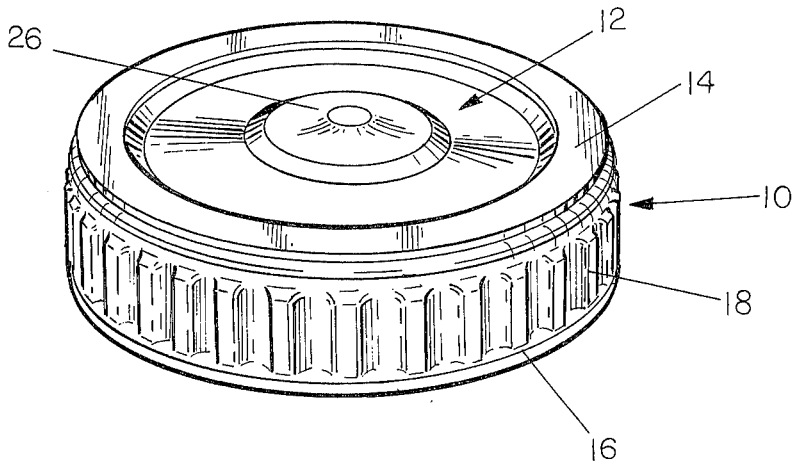
FIG. 1 is a perspective view of the improved home canning closure combination of this invention including a plastic ring and a metal lid in assembled relationship.
Figure 2:
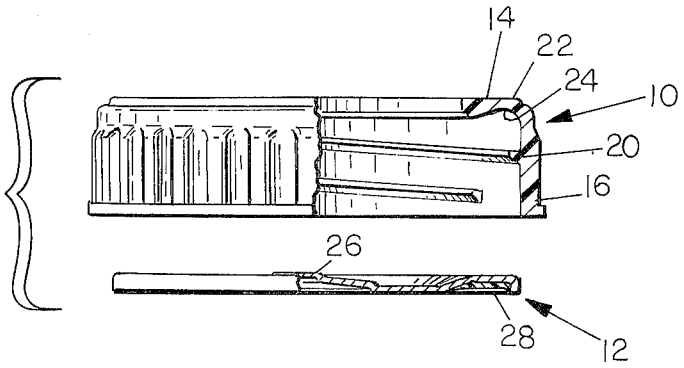
FIG. 2 is a front view, with portions broken away in section, of the separated plastic ring and metal lid of this invention.

Referring now to the drawings, FIGS. 1 and 2 show the unique plastic ring 10 and metal lid 12 of this invention.

The plastic ring 10 includes an annular top panel portion 14 and an annular skirt portion 16. The skirt 16 incorporates a plurality of raised ribs 18 around its outer surface which facilitate easy grasping by fingers. A plurality of buttress-style threads 20 are provided on the interior surface of the skirt 16. The annular top panel portion 14 has a tapered ramp portion 22 on its lower surface and a thin section 24 at the junction of the top panel 14 and the skirt 16.

The metal lid 12 incorporates a vacuum indicating button 26 in its center, an upwardly and outwardly inclined tapered portion 27, and annular sealing portion around its outer periphery which is filled with suitable sealing material, such as plastisol 28.

Figure 3:
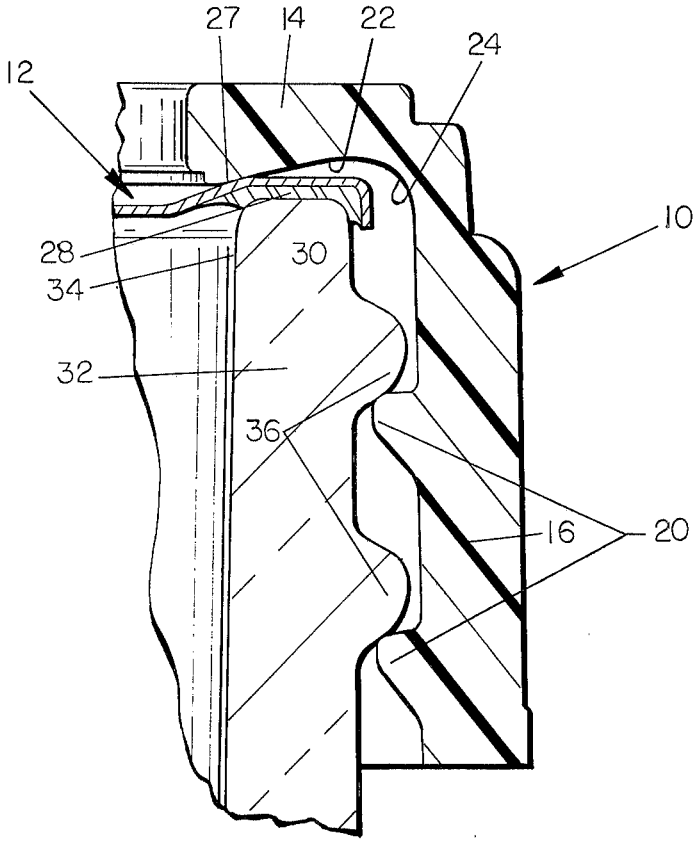
FIG. 3 is an enlarged, partial sectional view of the plastic ring and metal lid of this invention as applied to a home canning jar.

As can be seen in FIG. 3, metal lid 12 is adapted to be placed in engagement with the upper sealing rim 30 of a container neck 32 so that the sealing material 28 forms a seal with the rim 30. The metal lid 12 then effectively closes and seals the open mouth 34 of the container neck 32. The container neck 32 incorporates a plurality of threads 36 on its outer surface which are adapted to mate with buttress threads 20 on the plastic ring 10.

The unique ramp portion 22 and the thin section 24 create a spring action which provides a controlled pressure on the metal lid 12 during the cooling process. This controlled pressure ensures venting of the excessive pressure within the container to thereby avoid buckling of the metal lid 12. If such buckling were to occur, leakage or spoilage of the product may be experienced.

The use of the buttress thread design 20 provides a more constant vertical force between the plastic thread and top of the plastic ring 10, over a thread design which has a greater face angle (angle of the plastic thread where it contacts the glass thread). This force on the top of the metal lid is maintained as the plastic ring expands, due to the introduction of heat during the various canning processes.

We claim:

1. An improved home canning closure system for a container having a threaded neck portion terminating in an annular rim defining the periphery of an open mouth, said closure system including:

a metal lid covering and closing the open mouth of said container and having a sealant means positioned around the periphery of its lower surface and adapted to sealingly engage the annular rim defining the open mouth of said container, said metal lid including an upwardly and outwardly tapered portion positioned radially inwardly from said sealant means; and a plastic ring adapted to be placed over the metal lid and including an annular top panel portion and a skirt portion depending therefrom, the skirt portion incorporating buttress style threads adapted to engage the threaded neck portion on said container, the annular top panel portion including an upwardly and outwardly inclined ramp portion on the interior surface adapted to engage the tapered portion on said metal lid, and a reduced thickness section formed at the junction of said annular top panel portion and said skirt portion adapted to cooperate with said threaded engagement between the plastic ring and container to form a spring means to maintain a uniform force on said metal lid to bias the metal lid into sealing engagement with said container, said tapered portion on said metal lid and said inclined ramp portion on said plastic ring cooperating to allow flexing of the metal lid out of sealing engagement with said container when the force on said metal lid due to the pressure within said container exceeds the uniform force of said spring means on said metal lid to thereby vent said excess pressure from said container.

* * * * *